US009211478B1

(12) United States Patent
Bleus

(10) Patent No.: US 9,211,478 B1
(45) Date of Patent: Dec. 15, 2015

(54) CHEERING DEVICE GRIP

(71) Applicant: Peter Bleus, Sanford, FL (US)

(72) Inventor: Peter Bleus, Sanford, FL (US)

( * ) Notice: Subject to any disclaimer, the term of this patent is extended or adjusted under 35 U.S.C. 154(b) by 0 days.

(21) Appl. No.: 14/608,646

(22) Filed: Jan. 29, 2015

(51) Int. Cl.
*A63H 3/14* (2006.01)
*A63H 3/36* (2006.01)

(52) U.S. Cl.
CPC ..... *A63H 3/36* (2013.01)

(58) Field of Classification Search
USPC ..... 446/97, 100, 329, 330, 397, 418
See application file for complete search history.

(56) References Cited

U.S. PATENT DOCUMENTS

| | | | | |
|---|---|---|---|---|
| 385,002 | A * | 6/1888 | Pagan | 446/422 |
| D77,734 | S | 2/1929 | Bemelmans | |
| 3,490,410 | A * | 1/1970 | Crawford, Sr. | 116/67 R |
| 4,218,844 | A | 8/1980 | Knibbs | |
| 4,324,065 | A | 4/1982 | Cooper | |
| 4,504,240 | A | 3/1985 | Thomas | |
| 4,824,097 | A | 4/1989 | Axtell | |
| 5,016,749 | A | 5/1991 | Kaye et al. | |
| D319,756 | S | 9/1991 | Kimura | |
| 5,139,188 | A | 8/1992 | Scharf | |
| 5,368,518 | A | 11/1994 | Hitchcock | |
| 5,391,106 | A | 2/1995 | Lidert, Jr. | |
| D393,026 | S | 3/1998 | Ingram | |
| D394,288 | S * | 5/1998 | Trahan | D21/588 |
| D410,311 | S | 5/1999 | Ancona et al. | |
| D477,528 | S | 7/2003 | Adams et al. | |
| 8,555,416 | B1 * | 10/2013 | Sierra | 2/159 |
| 2009/0271911 | A1 * | 11/2009 | McKiski | 2/159 |

* cited by examiner

*Primary Examiner* — Nini Legesse

(57) ABSTRACT

A cheering device includes an upper head portion resembling an upper jaw and head of an animal and a lower head portion resembling a lower jaw and head of an animal. Each of the upper and lower head portions has a back side having a hand receiving well therein. The lower head portion has a planar upper surface and the upper head portion has a planar lower surface. Each of the upper and lower portions may be positioned on a person's hands and the upper surface of the lower head portion struck against the lower surface of the upper head portion to create an audible sound.

9 Claims, 4 Drawing Sheets

FIG. 1
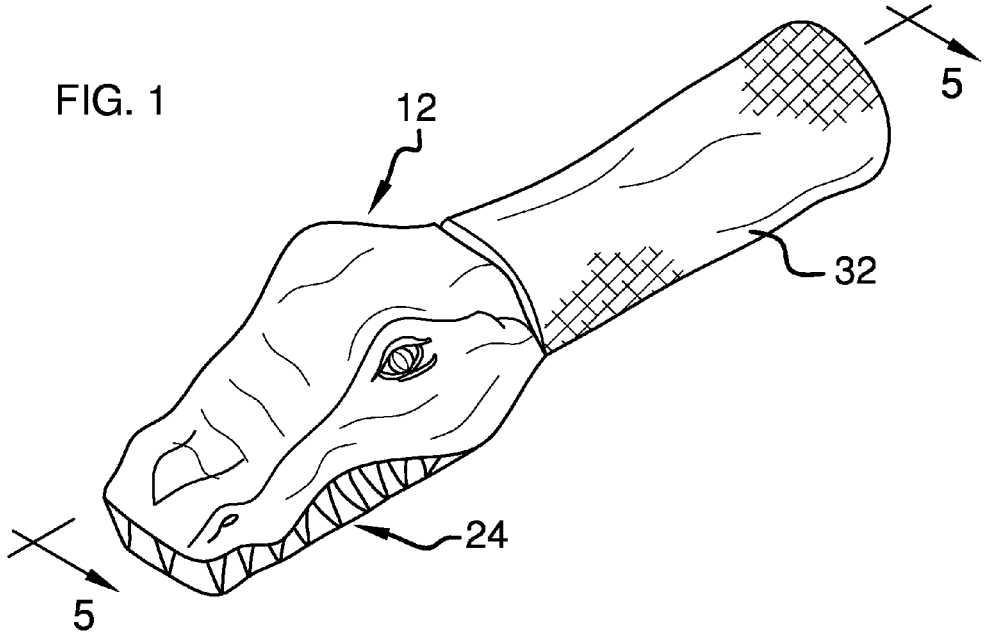
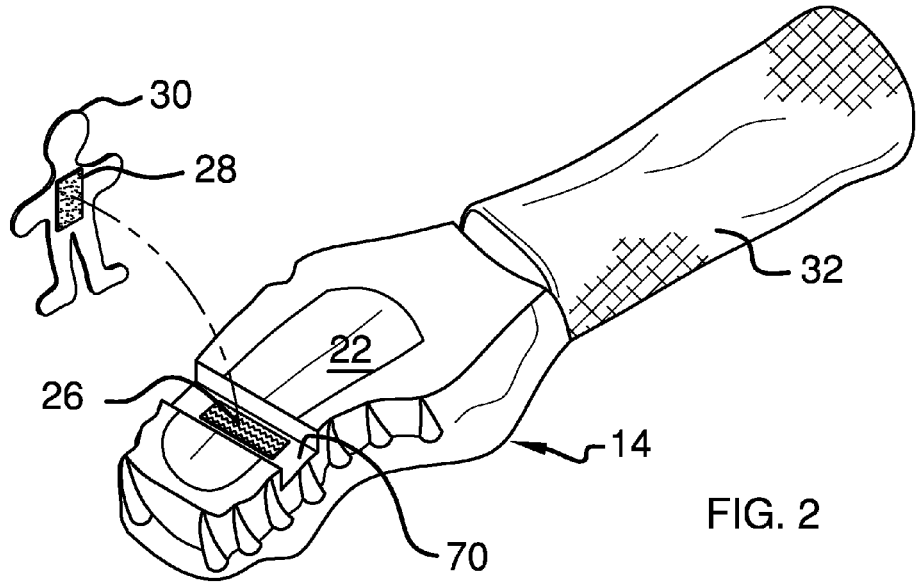
FIG. 2

CHEERING DEVICE GRIP

BACKGROUND OF THE DISCLOSURE

Field of the Disclosure

The present invention relates to cheering devices and more particularly pertains to a new cheering device for positioning on the hands of a person to allow the person to make clapping noises during a sporting event.

SUMMARY OF THE DISCLOSURE

An embodiment of the disclosure meets the needs presented above by generally comprising an upper head portion resembling an upper jaw and head of an animal and a lower head portion resembling a lower jaw and head of an animal. Each of the upper and lower head portions has a back side having a hand receiving well therein. The upper and lower head portions are comprised of a rigid material. The lower head portion has a planar upper surface and the upper head portion has a planar lower surface. Each of the upper and lower portions may be positioned on a person's hands and the upper surface of the lower head portion struck against the lower surface of the upper head portion to create an audible sound.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein:

FIG. 1 is a perspective view of an upper head portion of a cheering device according to the present invention.

FIG. 2 is a perspective view of a lower head portion of the present invention.

DESCRIPTION OF THE PREFERRED EMBODIMENT

Figure 3:
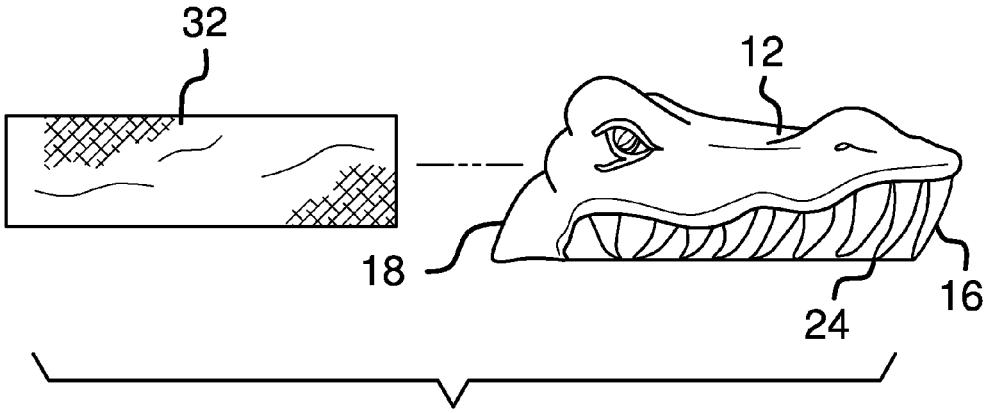
FIG. 3 is an expanded side view of the upper head portion of the present invention.
Figure 4:
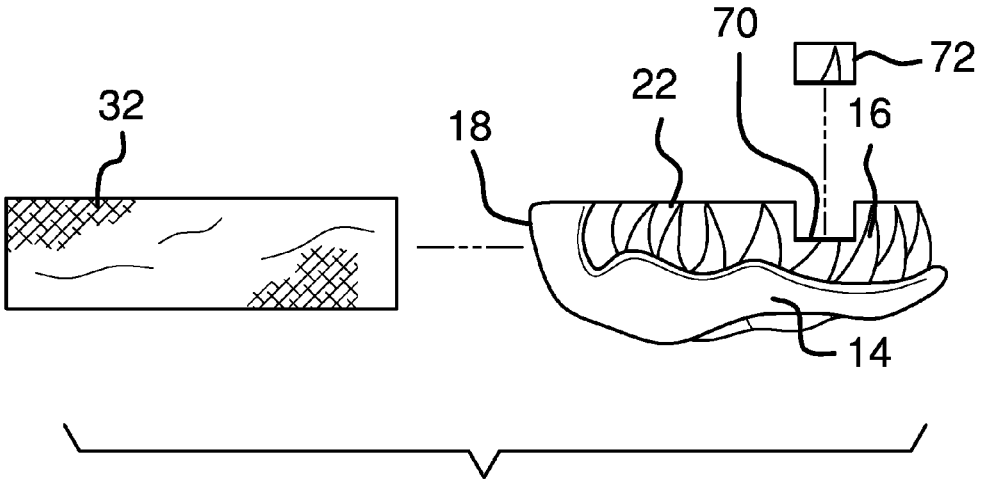
FIG. 4 is an expanded side view of the lower head portion present invention.
Figure 5:
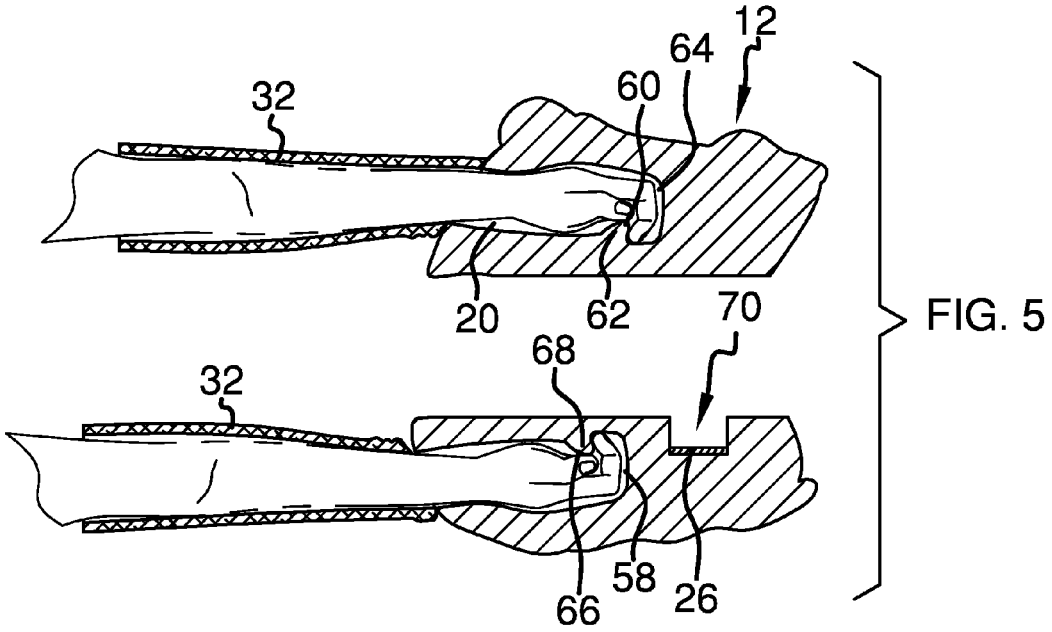
FIG. 5 is a cross-sectional view taken along line 5-5 of FIG. 1 of the present invention.
Figure 6:
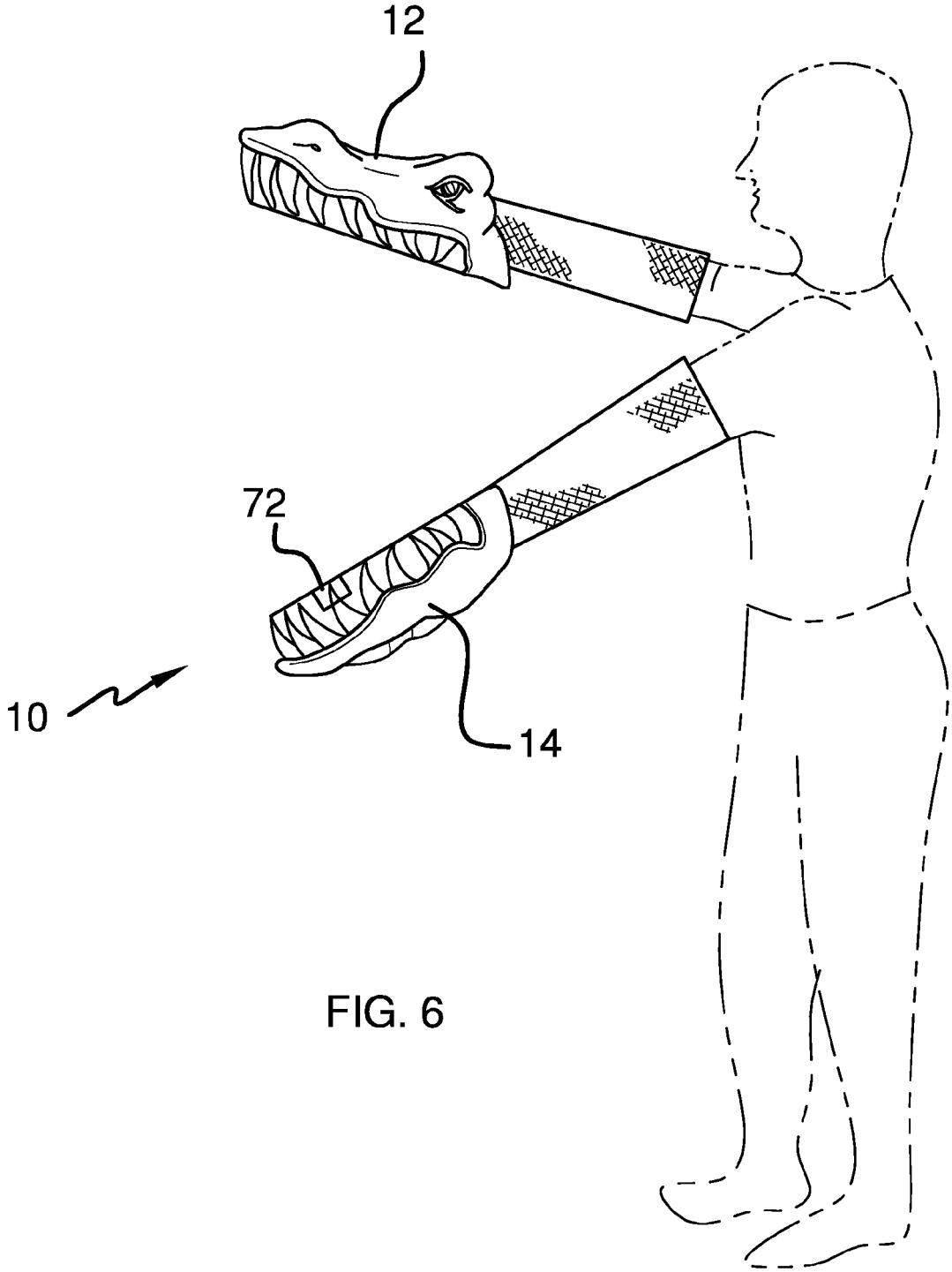
FIG. 6 is a side in-use view of the present invention.

With reference now to the drawings, and in particular to FIGS. 1 through 6 thereof, a new cheering device embodying the principles and concepts of an embodiment of the disclosure and generally designated by the reference numeral 10 will be described.

As best illustrated in FIGS. 1 through 6, the cheering device 10 generally comprises an upper head portion 12 resembling an upper jaw and head of an animal and a lower head portion 14 resembling a lower jaw and head of an animal. The animal may be an alligator and the sides of the upper 12 and lower 14 head portions have teeth indicia 16 thereon. Each of the upper 12 and lower 14 head portions has a back side 18 having a hand receiving well 20 therein. The hand receiving well 20 in the upper head portion 12 is configured to receive a hand in a downwardly facing palm position and the hand receiving well 20 in the lower head portion 14 is configured to receive a hand in an upwardly facing palm position. The hand receiving well 20 of the upper head portion 12 has a curved section 60 defining an upper interior lip 62 within the hand receiving well 20 of the upper head portion 12. The upper interior lip 62 is positioned at a distal end 64 of the hand receiving well 20 of the upper head portion 12 wherein the upper interior lip 62 is configured for being grasped by fingers of the person's hand inserted into the hand receiving well 20 of the upper head portion 12 facilitating grasping of the upper head portion 12 by the person's hand inserted into the hand receiving well 20 of the upper head portion 12. Similarly, the hand receiving well 20 of the lower head portion 14 has an arcuate section 66 defining a lower interior lip 68 within the hand receiving well 20 of the lower head portion 14. The lower interior lip 68 is positioned at a distal end 58 of the hand receiving well 20 of the lower head portion 14 wherein the lower interior lip 68 is configured for being grasped by fingers of the person's hand inserted into the hand receiving well 20 of the lower head portion 14 facilitating grasping of the lower head portion 14 by the hand inserted into the hand receiving well 20 of the lower head portion 14.

Each of the upper 12 and lower 14 head portions is comprised of a rigid material. The rigid material may include a plastic material or a wood material. The lower head portion 14 has a planar upper surface 22 and the upper head portion 12 has a planar lower surface 24.

A first mating member 26 is attached to the upper surface 22 of the lower head portion 14. A second mating member 28 is attached to a mascot doll 30. The first mating member 26 and the second mating member 28 releasably secure the mascot doll 30 to the lower head portion 14. This will give the impression that the upper 12 and lower 14 head portions form an alligator eating the mascot doll 30. The second mating member 28 may be secured to any mascot doll 30. The first mating member 26 may be positioned in a trough 70 formed in the upper surface of the lower head portion 14 and extending through the sides thereof. The trough 70 may be filled with a block member 72 when a mascot doll 30 is not positioned in the trough 70. By positioning the mascot doll 30 in the trough, the mascot doll 30 will not deaden the sound of the upper 12 and lower 14 head portions being struck together.

A pair of sleeves 32 is provided. Each of the back sides 18 has one of the sleeves 32 attached thereto and each is aligned with an associated one of the hand receiving wells 20. The sleeves 32 are comprised of a resiliently stretchable material.

In use, each of the upper 12 and lower 14 portions may be positioned on a person's hands and the upper surface 22 of the lower head portion 14 struck against the lower surface 24 of the upper head portion 14 to create an audible sound. The apparatus 10 may be used for cheering on a home team during a sporting event.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A cheering device comprising:

an upper head portion resembling an upper jaw and head of an animal and a lower head portion resembling a lower jaw and head of an animal, each of said upper and lower head portions having a back side having a hand receiving well therein, each of said upper and lower head portions being comprised of a rigid material, said lower head portion having a planar upper surface, said upper head portion having a planar lower surface;

wherein each of said upper and lower portions may be positioned on a person's hands and said upper surface of said lower head portion struck against said lower surface of said upper head portion to create an audible sound;

said upper surface of said lower head portion having a trough therein, a block member being removably positionable in said trough to fill said trough, wherein a mascot doll is positionable in said trough when said block member is removed from said trough.

2. The device of claim 1, further comprising a first mating member being attached to said upper surface of said lower head portion and being positioned within said trough, a second mating member being attached to said mascot doll, said first mating member and said second mating member releasably securing said mascot doll to said lower head portion.

3. The device of claim 2, further comprising said first mating member being magnetically couplable to said second mating member.

4. The device of claim 1, further comprising a pair of sleeves, each of said back sides having one of said sleeves attached thereto and being aligned with an associated one of said hand receiving wells, each of said sleeves being comprised of a resiliently stretchable material.

5. The device of claim 1, further comprising said hand receiving well of said upper head portion having a curved section defining an upper interior lip within said hand receiving well of said upper head portion, said upper interior lip being positioned at a distal end of said hand receiving well of said upper head portion wherein said upper interior lip is configured for being grasped by fingers of the person's hand inserted into said hand receiving well of said upper head portion facilitating grasping of said upper head portion by the person's hand inserted into said hand receiving well of said upper head portion.

6. The device of claim 1, further comprising said hand receiving well of said lower head portion having an arcuate section defining a lower interior lip within said hand receiving well of said lower head portion, said lower interior lip being positioned at a distal end of said hand receiving well of said lower head portion wherein said lower interior lip is configured for being grasped by fingers of the person's hand inserted into said hand receiving well of said lower head portion facilitating grasping of said lower head portion by the hand inserted into said hand receiving well of said lower head portion.

7. A cheering device comprising:

an upper head portion resembling an upper jaw and head of an animal and a lower head portion resembling a lower jaw and head of an animal, each of said upper and lower head portions having a back side having a hand receiving well therein, each of said upper and lower head portions being comprised of a rigid material, said lower head portion having a planar upper surface, said upper head portion having a planar lower surface, said hand receiving well of said upper head portion having a curved section defining an upper interior lip within said hand receiving well of said upper head portion, said upper interior lip being positioned at a distal end of said hand receiving well of said upper head portion wherein said upper interior lip is configured for being grasped by fingers of a person's hand inserted into said hand receiving well of said upper head portion facilitating grasping of said upper head portion by the person's hand inserted into said hand receiving well of said upper head portion, said hand receiving well of said lower head portion having an arcuate section defining a lower interior lip within said hand receiving well of said lower head portion, said lower interior lip being positioned at a distal end of said hand receiving well of said lower head portion wherein said lower interior lip is configured for being grasped by fingers of the person's hand inserted into said hand receiving well of said lower head portion facilitating grasping of said lower head portion by the hand inserted into said hand receiving well of said lower head portion, wherein each of said upper and lower head portions are configured be positioned on the person's hands and said upper surface of said lower head portion struck against said lower surface of said upper head portion to create an audible sound;

said upper surface of said lower head portion having a trough therein, a block member being removably positionable in said trough to fill said trough, wherein a mascot doll is positionable in said trough when said block member is removed from said trough;

a first mating member being attached to said upper surface of said lower head portion and being positioned within said trough, a second mating member being attached to said mascot doll, said first mating member and said second mating member releasably securing said mascot doll to said lower head portion, said first mating member being magnetically couplable to said second mating member; and a pair of sleeves, each of said back sides having one of said sleeves attached thereto and being aligned with an associated one of said hand receiving wells, each of said sleeves being comprised of a resiliently stretchable material.

8. A cheering device comprising:

an upper head portion resembling an upper jaw and head of an animal and a lower head portion resembling a lower jaw and head of an animal, each of said upper and lower head portions having a back side having a hand receiving well therein, each of said upper and lower head portions being comprised of a rigid material, said lower head portion having a planar upper surface, said upper head portion having a planar lower surface;

a pair of sleeves, each of said back sides having one of said sleeves attached thereto and being aligned with an associated one of said hand receiving wells, each of said sleeves being comprised of a resiliently stretchable material;

wherein each of said upper and lower head portions is configured to be positioned on a person's hands and said upper surface of said lower head portion struck against said lower surface of said upper head portion to create an audible sound; and a first mating member being attached to said upper surface of said lower head portion and being positioned within a trough, a second mating member being attached to a mascot doll, said first mating member and said second mating member releasably securing said mascot doll to said lower head portion.

9. The device of claim 8, further comprising said first mating member being magnetically couplable to said second mating member.

* * * * *